US007926670B2

(12) United States Patent
Schneider

(10) Patent No.: US 7,926,670 B2
(45) Date of Patent: Apr. 19, 2011

(54) TRUCK MOUNTED TELESCOPIC BOOM STRUCTURE INCLUDING A STOWABLE JIB BOOM WITH A STOWABLE PERSONNEL BASKET

(75) Inventor: Willaim Schneider, Malcolm, NE (US)

(73) Assignee: Westchester Capital, LLC, Omaha, NE (US)

( * ) Notice: Subject to any disclaimer, the term of this patent is extended or adjusted under 35 U.S.C. 154(b) by 164 days.

(21) Appl. No.: 12/387,396

(22) Filed: May 1, 2009

(65) Prior Publication Data

US 2010/0276386 A1 Nov. 4, 2010

(51) Int. Cl.
*B66C 23/42* (2006.01)

(52) U.S. Cl. ..... 212/168; 182/2.8; 182/2.11; 212/300

(58) Field of Classification Search ..... 182/2.8, 182/2.9, 2.11; 212/168, 300
See application file for complete search history.

(56) References Cited

U.S. PATENT DOCUMENTS

| | | | | |
|---|---|---|---|---|
| 4,724,924 | A * | 2/1988 | Breyer et al. | 182/2.8 |
| 6,024,191 | A * | 2/2000 | Backer et al. | 182/69.6 |
| 6,250,485 | B1 * | 6/2001 | Olson | 212/260 |
| 7,337,912 | B1 * | 3/2008 | Hull | 212/300 |

FOREIGN PATENT DOCUMENTS

| | | | |
|---|---|---|---|
| JP | 3-162398 | A * | 7/1991 |
| JP | 2000-229792 | A * | 8/2000 |
| JP | 2001-39679 | A * | 2/2001 |
| JP | 2005-255290 | A * | 9/2005 |

* cited by examiner

*Primary Examiner* — Thomas J Brahan
(74) *Attorney, Agent, or Firm* — Dennis L. Thomte; Thomte Patent Law Office LLC

(57) ABSTRACT

A truck mounted telescopic boom structure including a stowable jib boom having a stowable personnel basket mounted thereon is described. A mounting structure is provided at the outer end of the innermost boom section of the boom structure and includes means for pivotally moving a work platform or basket between operative and stowed positions. When the boom structure and the jib boom are in their stowed positions, the personnel basket is positioned closely adjacent the jib boom at one side thereof so as to be within the highway width restrictions. The instant invention enables the personnel basket to be connected to the outer end of the jib boom at all times without the necessity of removing the personnel basket from the jib boom when the jib boom and the boom structure are in their stowed positions.

10 Claims, 7 Drawing Sheets

TRUCK MOUNTED TELESCOPIC BOOM STRUCTURE INCLUDING A STOWABLE JIB BOOM WITH A STOWABLE PERSONNEL BASKET

BACKGROUND OF THE INVENTION

1. Field of the Invention

This invention relates to a truck having a telescoping boom structure mounted thereon. More particularly, this invention relates to a stowable jib boom for the boom structure with the jib boom having a personnel basket, bucket or platform mounted thereon. Even more particularly, this invention relates to a unique mounting system for mounting the personnel basket on the jib boom which enables the personnel basket to be stowed on the truck deck or bed adjacent the jib boom without disconnecting the personnel basket from the jib boom, when the jib boom and the boom structure are in their stowed positions.

2. Description of the Related Art

Truck mounted telescopic boom structures or cranes frequently have a jib boom mounted on the outer end of the innermost boom section to enable the boom structure to perform tasks which would not be possible without the jib boom. The jib booms of the prior art are usually pivotally mounted to the outer end of the innermost boom section so that the jib boom may be pivotally moved between an operative extended position to an inoperative stowed position adjacent one side of the boom structure. A personnel basket, bucket, work platform, etc. is frequently mounted on the outer end of the jib boom. However, if the personnel basket is not disconnected from the jib boom when the jib boom and the boom structure are in their stowed positions, the personnel basket will protrude laterally from the side of the truck and will cause the truck to be "over width." To avoid the "over width" problem, the personnel basket is usually disconnected from the jib boom and stowed on the truck deck or bed or even placed on a trailer or the like. When it is desired to again connect the personnel basket to the jib boom, the boom structure must be extended with the jib boom then being pivoted to its operative position. The personnel basket, which may weigh 200-300 pounds, must then be moved to where the outer end of the jib boom is positioned. The personnel basket must then be properly aligned with the jib boom to enable attachment bolts or pins to be properly placed to connect the basket to the jib boom, which is a difficult task at best, especially if the basket is not positioned on a level surface or if the truck is on an uneven surface.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A truck mounted telescopic boom structure including a stowable jib boom with a stowable personnel basket is disclosed herein. The truck has forward and rearward ends and opposite sides. The truck includes a cab at the forward end thereof and a deck or platform, having rearward and forward ends and opposite sides, which extends rearwardly from the cab. An upstanding pedestal is rotatably mounted, about a vertical axis, on the truck adjacent the rearward end of the deck or platform. A telescoping boom structure, including an elongated outer boom section, having inner and outer ends and opposite sides, with at least one elongated inner boom section telescopically received thereby is provided on the truck with the inner end of the outer boom section being pivotally secured, about a horizontal axis, to the pedestal. The boom structure is selectively movable between an operative position and a stowed position.

An elongated jib boom, having inner and outer ends, is mounted on the boom structure with the inner end of the jib boom being pivotally secured to the outer end of the inner boom section whereby the jib boom is movable between a first operative position and a second stowed position relative to the boom structure. The jib boom, when in its first operative position, is generally parallel to and extends outwardly from the inner boom section. The jib boom, when in its second stowed position, extends from the outer end of the inner boom section towards the inner end of the boom structure adjacent one side of the outer boom section. The first end of an elongated first support is pivotally secured to the outer end of the jib boom about a first axis. The first end of a second elongated support is pivotally secured to the second end of the first support about a second axis which is transverse to the first axis. The first end of a third elongated support is pivotally secured to the second end of a second support about a third axis which is transverse with respect to the first and second axes.

A personnel basket is connected to the second end of the third support. The first, second and third supports and the first, second and third axes permit the third support and the personnel basket to hang downwardly from the outer end of the jib boom when the boom structure is in its operative position and the jib boom is in its operative position. The first, second and third supports and the first, second and third axes permit the second and third supports to extend forwardly from the outer end of the jib boom, when the jib boom structure is in its stowed position and the jib boom is in its stowed position so that the personnel basket may be positioned on the deck of the truck adjacent the jib boom without exceeding highway width restrictions.

It is therefore a principal object of the invention to provide a truck mounted telescopic boom structure including a stowable jib boom with a stowable personnel basket.

A further object of the invention is to provide a stowable jib boom with a stowable personnel basket which permits the personnel basket to be stowed adjacent the jib boom when the boom structure and the jib boom are in their stowed positions.

A further object of the invention is to provide a device of the type described wherein the personnel basket does not have to be removed from the jib boom when the boom structure and the jib boom are in their stowed positions.

A further object of the invention is to provide a device of the type described which is convenient and safe to use.

A further object of the invention is to provide a device of the type describe which may be mounted on a truck mounted boom structure without extensive modification of the boom structure or the jib boom.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
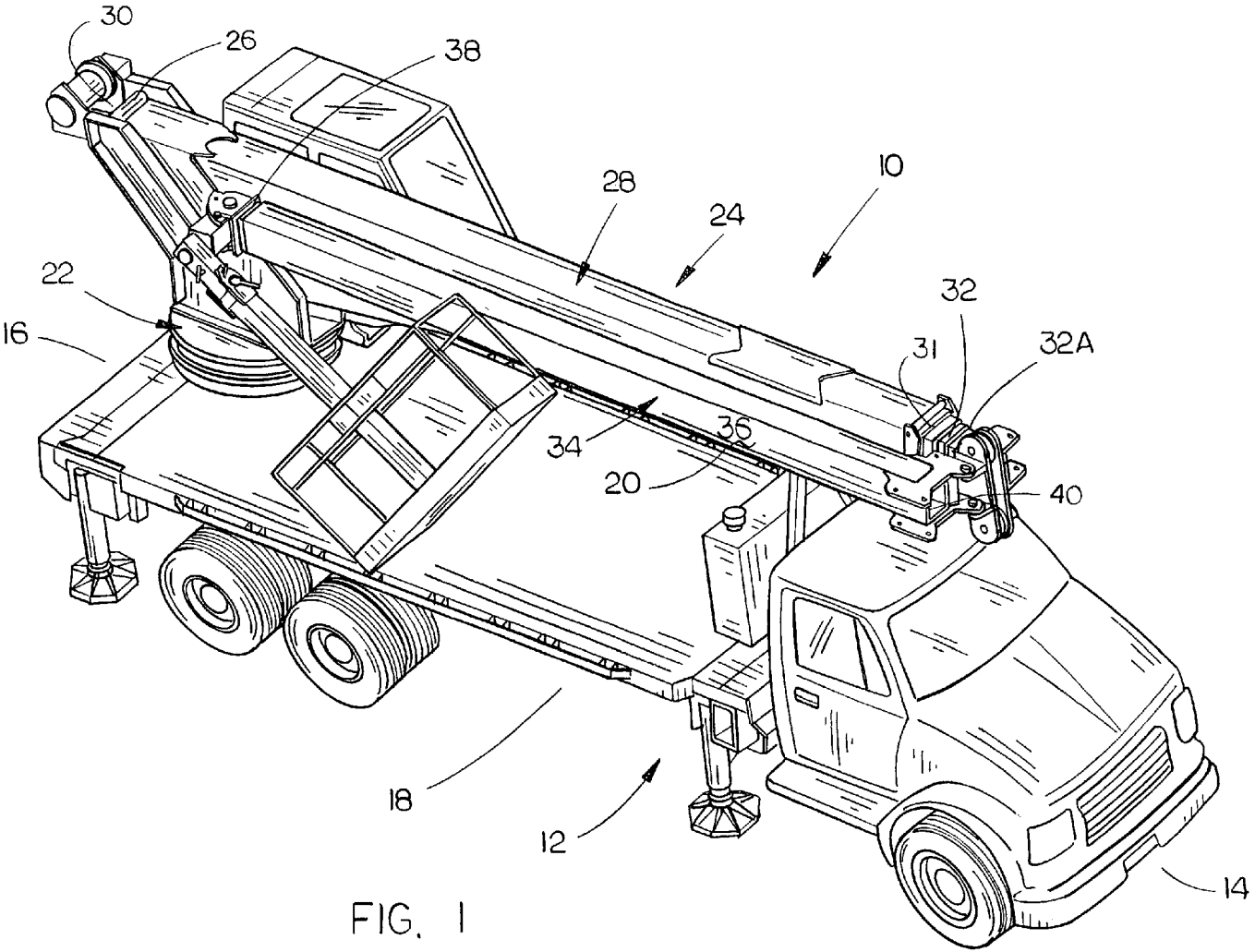
FIG. 1 is a front perspective view of the invention with the telescopic boom structure, jib boom and personnel basket being in their stowed positions.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers generally to a conventional truck mounted boom structure with the numeral 12 referring to the truck or vehicle including a forward end 14, rearward end 16, and opposite sides 18 and 20. The numeral 22 refers to a conventional rotatable pedestal having a telescopic boom structure 24 pivotally secured thereto about a horizontal axis referred to generally by the reference numeral 26.

Boom structure 24 includes an outer boom section 28 having a rearward end 30 and a forward end 31. A plurality of inner boom sections 32 are telescopically and slidably received within one another and within the outer boom section 28. For purposes of description, the innermost inner boom section will be referred to by the reference numeral 32A. The inner boom sections 32 are telescopically moved within outer boom section 28 by conventional structure. Further, the pedestal 22 is rotated with respect to the truck 12 in conventional fashion. Additionally, the boom section 24 is moved upwardly and downwardly by means of conventional hydraulic cylinders.

The numeral 34 refers to a jib boom which will normally include an outer jib boom section 36 and an inner jib boom section 38 which is telescopically movably mounted within outer jib boom section 36. The inner end 40 of jib boom 34 is pivotally secured to the outer end of the innermost boom section 32A so that the jib boom 34 may be pivotally moved from the stowed position as seen in FIG. 1 to an extended position wherein jib boom 34 is parallel to and extends outwardly from the outer end of the boom structure in conventional fashion.

Figure 2:
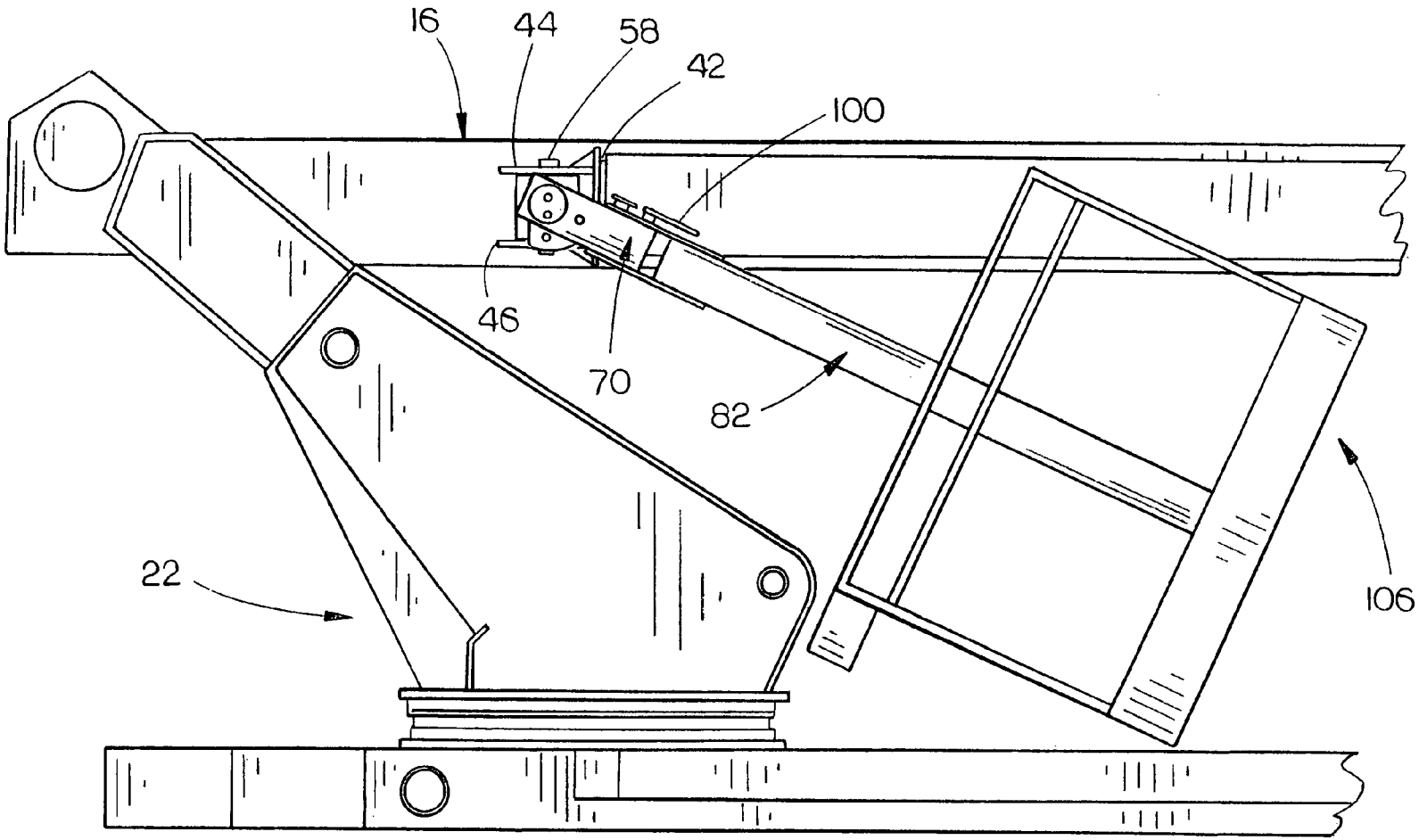
FIG. 2 is a partial side view of the invention with the boom structure, jib boom and personnel basket being in their stowed positions.
Figure 3:
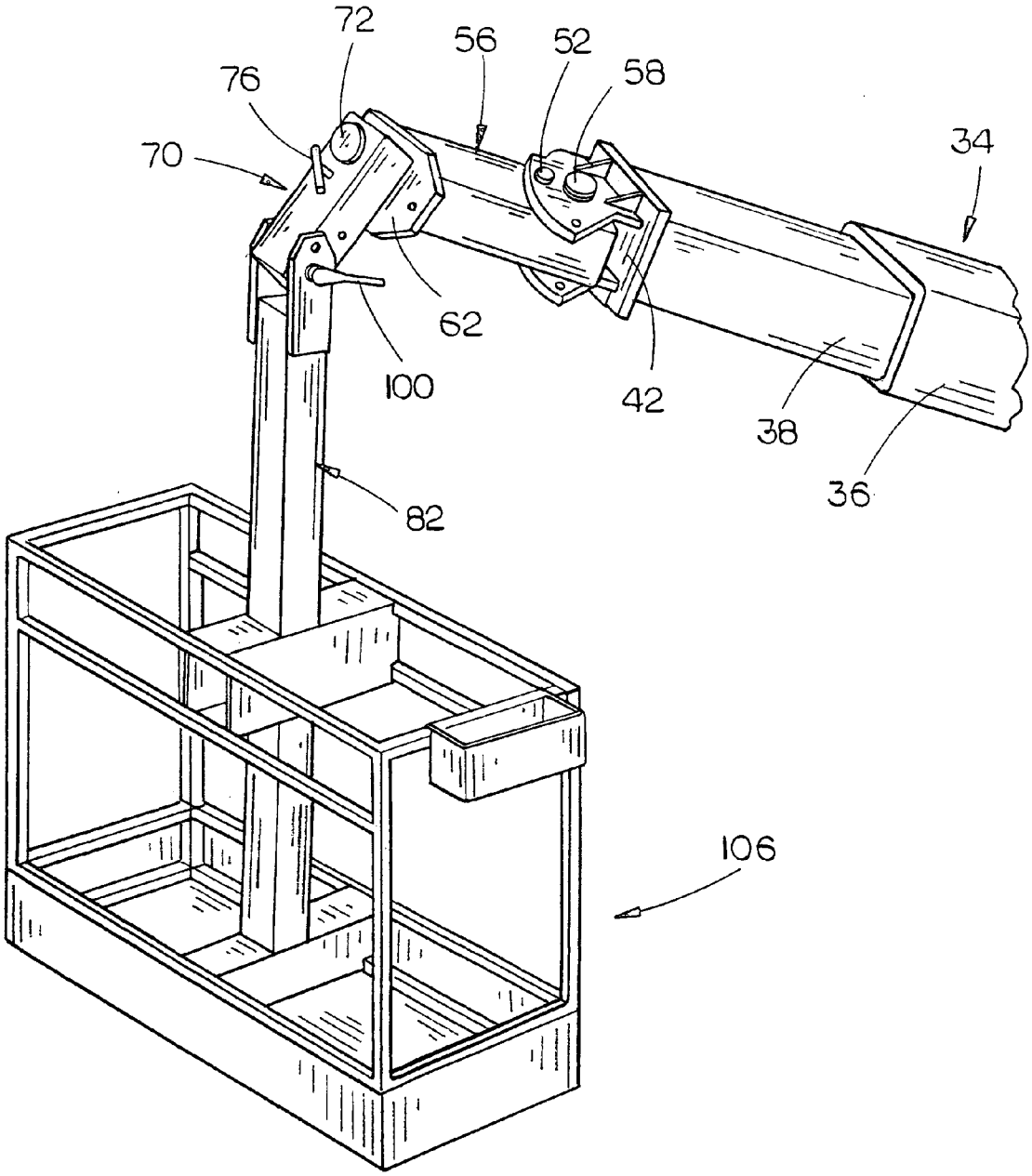
FIG. 3 is a partial rear perspective view of the personnel basket and the structure which mounts the personnel basket to the outer end of the jib boom.
Figure 4:
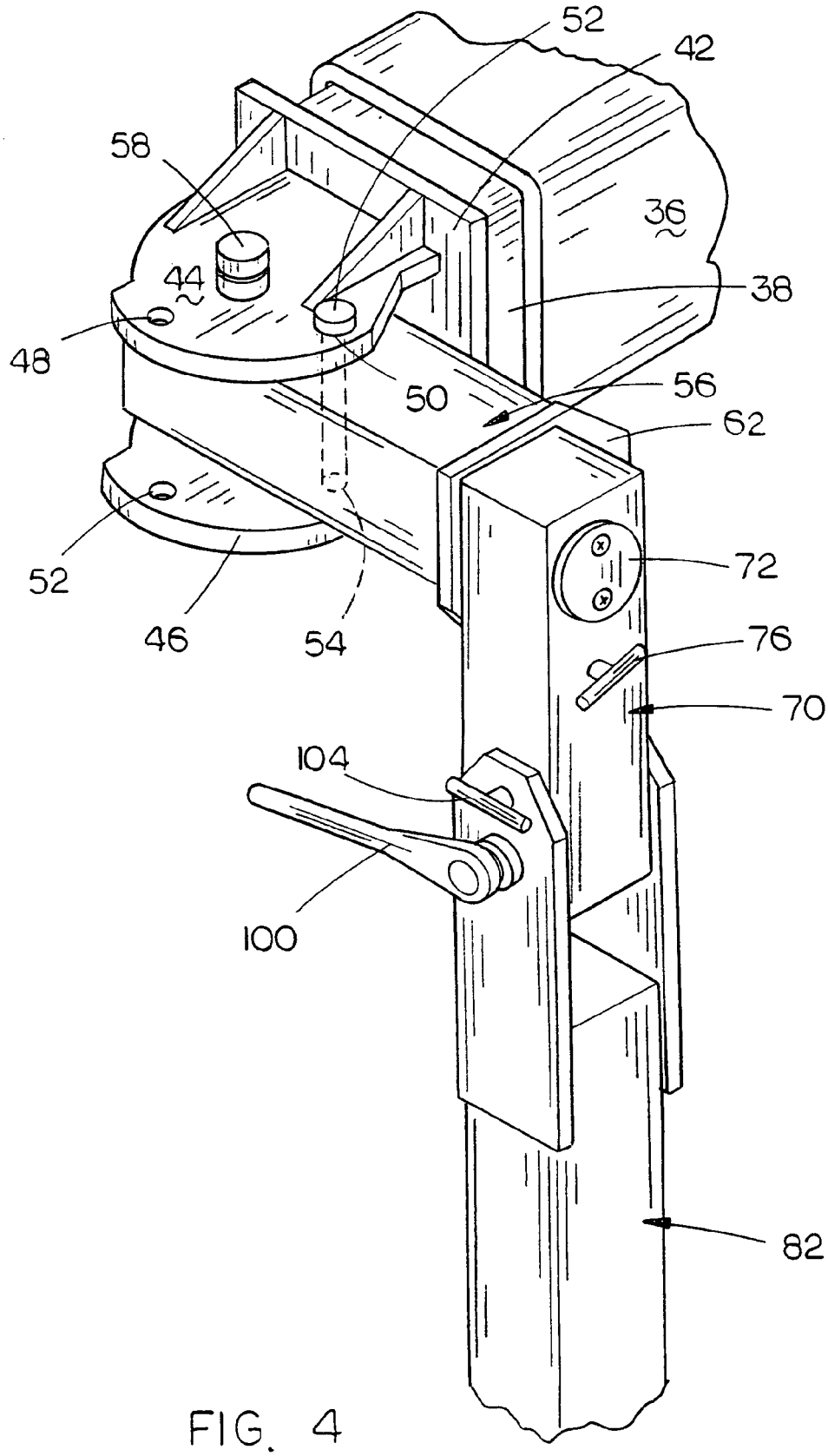
FIG. 4 is a partial perspective view of the mounting structure for mounting the personnel basket to the outer end of the jib boom.

Plate 42 is welded to the outer end of inner jib boom section 38 and has a pair of plates 44 and 46 welded thereto and which extend outwardly therefrom in a vertically spaced-apart manner (FIG. 2). Plate 44 is provided with a pair of openings 48 and 50 formed therein which are adapted to selectively receive a locking pin or bolt 52 therein (FIG. 4). Similarly, plate 46 includes openings 52 and 54 formed therein which register with openings 48 and 50 and which are adapted to receive the locking pin 52 as will be described hereinafter (FIG. 4).

Figure 5:
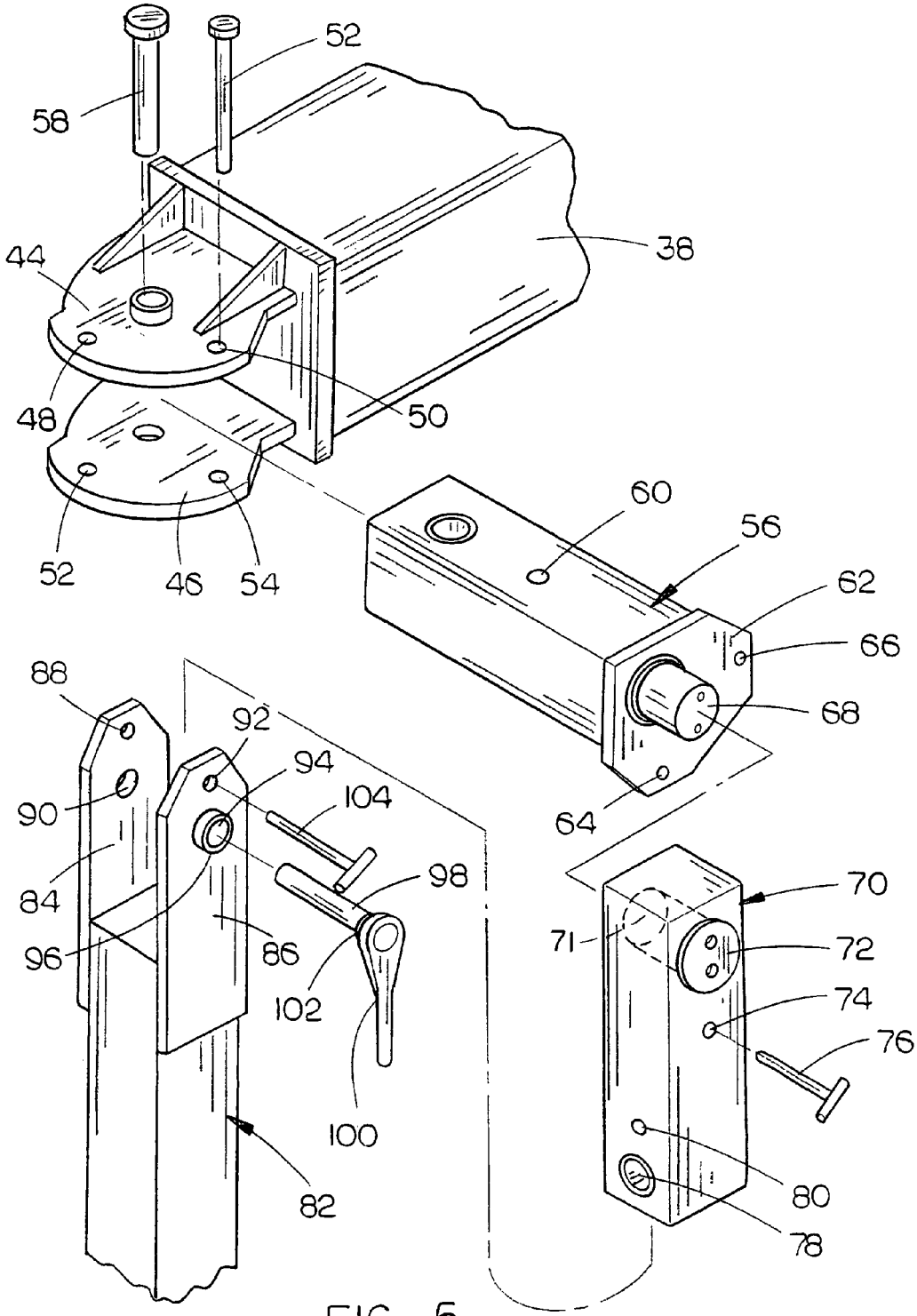
FIG. 5 is an exploded perspective view of the structure of FIG. 4.
Figure 6:
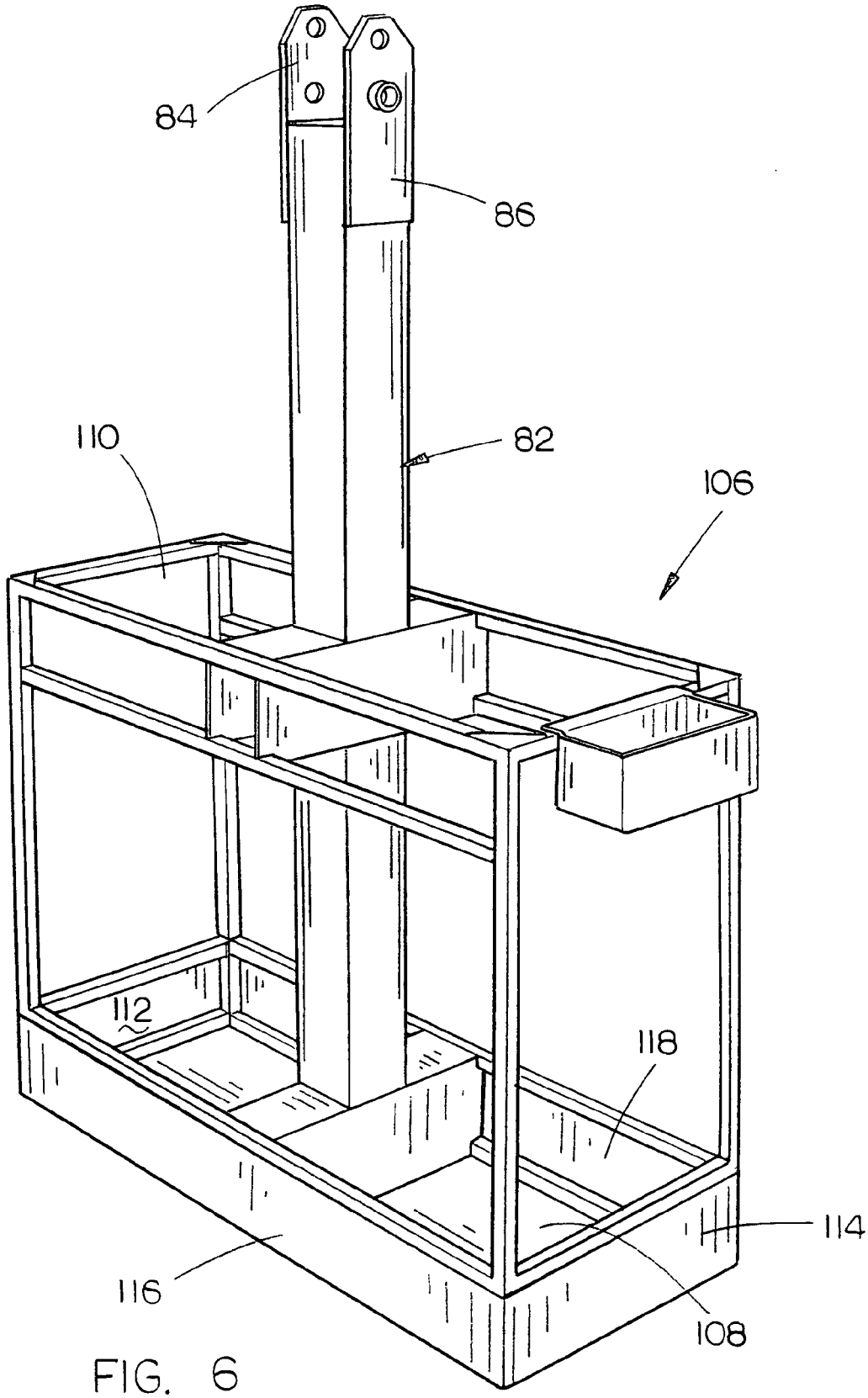
FIG. 6 is a perspective view of the personnel basket of this invention.

The numeral 56 refers to an elongated support having one end thereof pivotally secured to the plates 44 and 46 by pivot pin 58. For purposes of description, pivot pin 58 will be described as providing a first axis. Support 56 has an opening 60 extending therethrough which is adapted to register with the openings 50-54 and 48-52 so that the support 56 may be locked in two different positions as will be described hereinafter. The other end of support 56 has a plate 62 welded thereto which has openings 64 and 66 formed therein (FIG. 5). The numeral 68 refers to a pivot pin which extends outwardly from the support 56 through the plate 62.

The numeral 70 refers to a second support having an opening 71 formed in its upper end which receives the pivot pin 68 to pivotally mount the support 70 on the support 56. The pivot pin 68 will be referred to as providing a second axis. Support 70 includes a retainer plate 72 which is secured to the outer end of the pivot pin 68 to maintain support 70 on pivot pin 68 on support 56. Support 72 has an opening 74 extending therethrough which is adapted to register with either of the openings 64 and 66 so that a locking pin 76 may be extended through the opening 74 into either the opening 64 or the opening 66. The other end support 70 has a bore 78 formed therein and an opening 80 extending therethrough.

The numeral 82 refers to a third support having a pair of spaced-apart plates 84 and 86 secured thereto by welding (FIG. 5). Plate 84 includes openings 88 and 90 while plate 86 includes openings 92 and 94. An internally threaded bushing 96 is positioned in the opening 94, and is adapted to receive the pivot pin 98 extending therethrough and through opening 78. Handle 100 is secured to pin 98 with the pin 98 having external threads 102 which may be threadably secured to the threaded bushing 96. The numeral 104 refers to a locking pin which is adapted to be extended through the opening 92, opening 80 in support 70 and opening 88 (FIG. 8).

The numeral 106 refers to a personnel basket which is preferably rectangular in shape and which has a closed bottom or lower end 108, an open upper end 110, end portions 112 and 114 and side portions 116 and 118. Support 82 is secured to the basket 106 by any convenient means such as by welding or the like.

Figure 7:
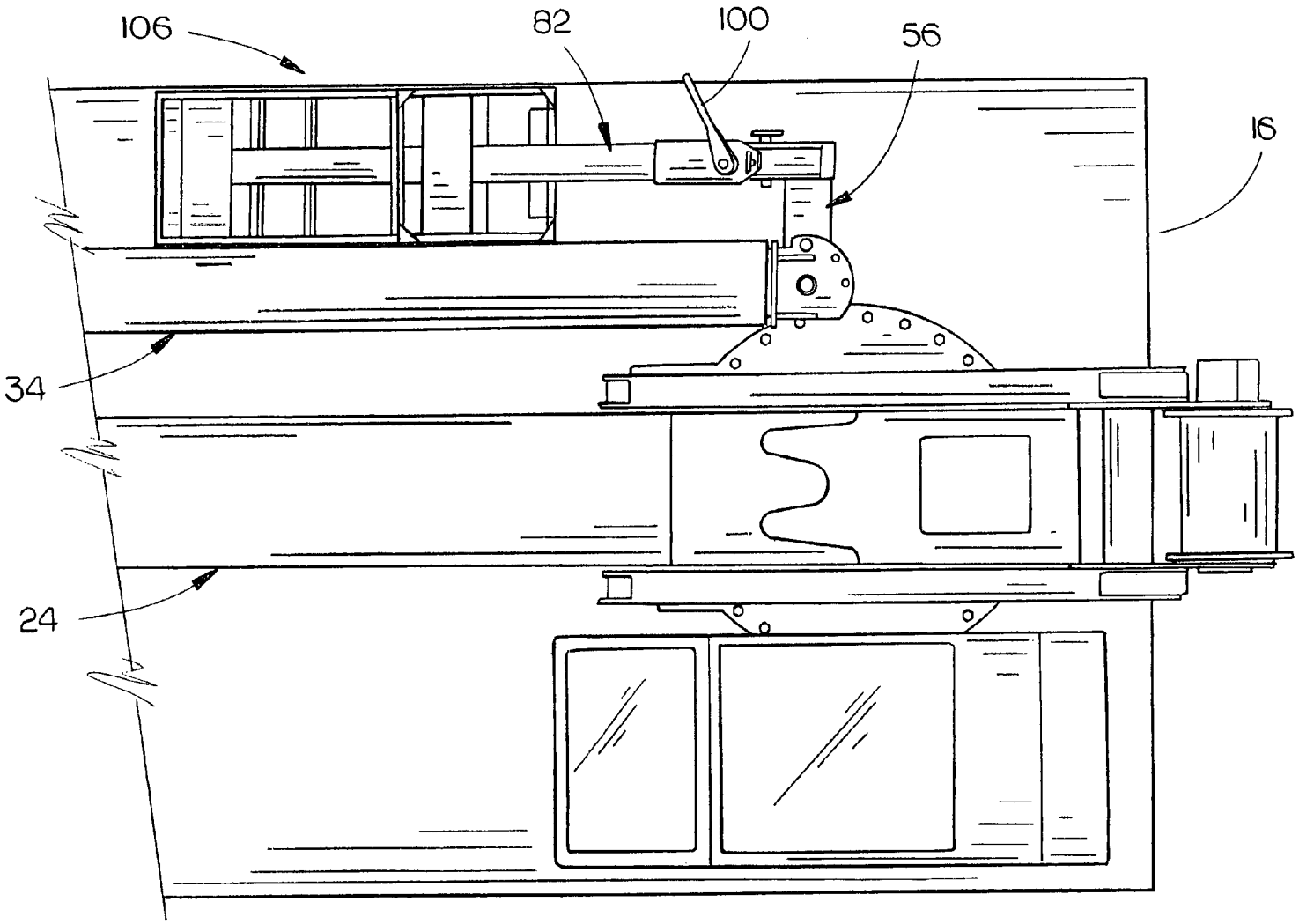
FIG. 7 is a partial top view illustrating the boom structure, jib boom and personnel basket in their stowed positions.

In normal use, when the jib boom 34 and the personnel basket 106 are not needed, the jib boom 34 will remain in its stowed position adjacent outer boom 28 at one side thereof. In that position, support 56 will be disposed at a right angle with respect to the longitudinal axis of jib boom 34 and with pin 52 being positioned in opening 50 in plate 44, opening 60 in support 56, and opening 54 in plate 46. Support 70 will be positioned so as to be generally parallel to the longitudinal axis of jib boom 34 with pin 76 extending through opening 74 in support 70 and opening 66 in support 56. Support 82 will be positioned with respect to support 70 by extending pin 104 through opening 92 in plate 86, through opening 74 in support 70, and through opening 88 in plate 84. If the boom structure 34 and the jib boom are in their stowed positions, the basket 106 will be in the stowed position of FIGS. 1, 2 and 7 closely adjacent the jib boom 34 so as not to exceed the highway width restrictions.

If the jib boom 34 is to be used, the jib boom 34 is pivotally movable to its operative position wherein the jib boom 34 extends outwardly from the inner boom section 32A parallel thereto. Support 56 will be pivoted so as to be parallel to inner boom section 32A with the pin 52 being extended through opening 48 in plate 44, opening 60 in support 56 and through opening 52 in plate 46. Pin 76 will be removed from opening 74 in support 70 and opening 66 in plate 62 of support 56 which will permit support 70 to freely pivot about pivot pin 68. If desired, pin 76 may be inserted through opening 74 in support 76 and through opening 64 in plate 62. At that same time, pin 104 is removed from opening 92 in plate 86, opening 80 in support 70 and opening 88 in plate 84 so that support 82 and basket 106 may freely pivot with respect to the jib boom about the axis defined by pin 98. When it is desired to stow the jib boom 34 and the basket 106, the above described procedure is reversed.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. In combination:

a self-propelled vehicle having forward and rearward ends and opposite sides;

said vehicle including a cab at the forward end thereof and a deck, having rearward and forward ends and opposite sides, extending rearwardly from said cab;

an upstanding pedestal rotatably mounted, about a vertical axis, on said vehicle adjacent said rearward end of said deck;

a telescoping boom structure including an elongated outer boom section, having inner and outer ends and opposite sides, with at least one elongated inner boom section, having inner and outer ends, telescopically received thereby;

an elongated jib boom having inner and outer ends;

said inner end of said jib boom being pivotally secured to said outer end of said inner boom section whereby said jib boom is movable between a first operative position and a second stowed position relative to said boom structure;

said jib boom, when in its said first operative position, being generally parallel to and extending outwardly from said inner boom section;

said jib boom, when in its said second stowed position, extending from said outer end of said inner boom section towards said inner end of said boom structure adjacent one side of said outer boom section;

a first elongated support having first and second ends;

said first end of said first support being pivotally secured to said outer end of said jib boom about a first axis;

a second elongated support having first and second ends;

said first end of said second support being pivotally secured to said second end of said first support about a second axis transverse to said first axis;

a third elongated support having first and second ends;

said first end of said third support being pivotally secured to said second end of said second support about a third axis which is transverse with respect to said first and second axes;

a personnel basket having a closed lower end, an open upper end, a first end portion, a second end portion, a first side portion and a second side portion;

said second end of said third support being secured to said personnel basket;

said first, second and third supports and said first, second and third axes permitting said third support and said personnel basket to hang downwardly from said outer end of said jib boom when said boom structure is in its said operative position and said jib boom is in its said first operative position;

said first, second and third supports and said first, second and third axes permitting said second and third supports to extend forwardly from said outer end of said jib boom, when said boom structure is in its said stowed position and jib boom is in its said second stowed position, so that said personnel basket may be positioned on said deck adjacent said jib boom.

2. The combination of claim 1 wherein said first support is selectively pivotally movable between first and second positions relative to said jib boom.

3. The combination of claim 2 further including locking means for locking said first support in its said first and second positions.

4. The combination of claim 1 wherein said second support is pivotally movable between operative and stowed positions relative to said first support.

5. The combination of claim 4 further including locking means for locking said second support in its said operative and stowed positions.

6. The combination of claim 1 further including means for locking said third support in a position wherein said third support is parallel to said second support.

7. The combination of claim 1 wherein said first support is selectively pivotally movable between first and second positions relative to said jib boom and wherein said second support is pivotally movable between operative and stowed positions relative to said first support.

8. The combination of claim 7 further including locking means for locking said first and second supports in their various positions.

9. The combination of claim 8 further including means for locking said third support in a position wherein said third support is parallel to said second support.

10. The combination of claim 1 wherein said jib boom includes an outer jib boom section and an inner jib boom section telescopically mounted on said outer jib boom section, said first end of said first elongated support being pivotally secured to said inner jib boom section.

* * * * *